US006385412B1

(12) United States Patent
Sadakuni

(10) Patent No.: US 6,385,412 B1
(45) Date of Patent: May 7, 2002

(54) IMAGE FORMING APPARATUS

(75) Inventor: Takayuki Sadakuni, Yokohama (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/722,719

(22) Filed: Nov. 28, 2000

(51) Int. Cl.[7] ..... G03G 15/00; G03G 21/00

(52) U.S. Cl. ..... 399/75; 399/9; 399/43; 399/81

(58) Field of Search ..... 399/75, 76, 81, 399/70, 9, 38, 43, 37, 88

(56) References Cited

U.S. PATENT DOCUMENTS 5,568,229 A * 10/1996 Szlucha ..... 399/43
5,666,584 A * 9/1997 Akashi et al. ..... 399/9
5,923,919 A 7/1999 Nimura et al. ..... 399/37
6,134,401 A * 10/2000 Yun et al. ..... 399/70

FOREIGN PATENT DOCUMENTS

| | | |
|---|---|---|
| JP | 04-362966 | * 12/1992 |
| JP | 9-62150 | 3/1997 |
| JP | 11-190962 | * 7/1999 |
| JP | 2001-066951 | * 3/2001 |

* cited by examiner

*Primary Examiner*—Sophia S. Chen
(74) *Attorney, Agent, or Firm*—Foley & Lardner

(57) ABSTRACT

A user is notified of an auto power off operation or an auto power save operation before the operation is executed. Therefore, an unexpected power off operation or unexpected switching into a power save mode can be avoided, and no extra labor or time is imposed on the user.

21 Claims, 8 Drawing Sheets

IMAGE FORMING APPARATUS

BACKGROUND OF THE INVENTION

The present invention relates to an image forming apparatus which is capable of executing events, such as "auto power off", "auto power save", "automatic image quality maintenance adjustment", etc., and which is exemplified by a digital copying machine.

In the conventional art, an image forming apparatus is known which can save standby power by its functions of "auto power off", "auto power save", etc. The auto power off function is a function of automatically turning off the power supply to the entire copying machine if no operation is performed during a preset length of time from the end of the last printing operation. The auto power save function is a function of automatically switching the copying machine into a power save mode (in which the copying machine is kept in the standby state, with minimum power applied) if no operation is performed during a preset length of time from the end of the last printing operation. The power save mode is an operation mode in which the power supply to the heat rollers of a fixing unit and to a fan is cut off, or the power supplied to the fixing unit is kept at a reduced level. When a copy is made after using the auto power off function or the auto power save function, a startup operation (e.g., a warming-up operation) has to be executed until the temperature of the fixing unit reaches a predetermined value.

Some image forming apparatuses (e.g., copying machines) have the function of an image quality maintenance adjustment or an automatic alignment adjustment. The automatic image quality maintenance adjustment enables automatic adjustment of the settings required for maintaining a desirable quality. The automatic alignment adjustment enables automatic adjustment of the settings required for a print image to be borne on a predetermined position. The automatic image quality maintenance adjustment and the automatic alignment adjustment are made when a predetermined length of time has elapsed or when a preset number of copies have been made.

The image forming apparatuses provided with the functions of "auto power off", "auto power save", "automatic image quality maintenance adjustment" and "automatic alignment adjustment", may have the following problems.

(1) Let us assume that a user intends to use a copying machine and is making preparations for documents to be copied in the neighborhood of the main body of the copying machine. If, in this situation, the auto power off function works, the user has to turn on the power supply to the main body and wait for the startup operation (e.g., a warming-up operation) to come to an end before the start of the copying operation. In this manner, if the auto power off function works and the main power supply of the copying machine is turned off when the user is near the main body of the copying machine, the user has to turn on the power supply and wait for the startup operation to come to an end before the start of the copying operation.

(2) As in the case (1) above, let us assume that a user intends to use a copying machine and is making preparations for documents to be copied in the neighborhood of the main body of the copying machine. If, in this situation, the auto power save function works, the user has to cancel the power save mode by operating the related key, and wait for the startup operation (e.g., a warming-up operation) to come to an end before the start of the copying operation. In this manner, if the auto power save function works and the copying machine is switched into the power save mode, the user has to operate the power save mode-canceling key and wait for the startup operation to come to an end before the start of the copying operation.

(3) Let us assume that the automatic image quality maintenance adjustment is unexpectedly made when the user is making a copy of a plural-page document. In this case, the copying operation is interrupted, and the user has to wait for the image quality maintenance adjustment to come to an end. Unless this adjustment comes to an end, the copying operation cannot be resumed. For this reason, a long time is required for completing the copying operation. In addition, the image quality of prints may vary before and after the image quality-adjusting operation. If the image quality markedly varies as a result of the image quality maintenance adjustment, it may happen that a copying operation for the plural-page document has to be executed again from the beginning.

(4) As in case (3) above, let us assume that the automatic alignment adjustment is unexpectedly made when the user is making a copy of a plural-page document. In this case, the copying operation is interrupted, and the user has to wait for the automatic alignment adjustment to come to an end. Unless this adjustment comes to an end, the copying operation cannot be resumed. For this reason, a long time is required for completing the copying operation. In addition, if the print position may greatly vary before and after the alignment adjustment, a copying operation for the plural-page document may have to be executed again from the beginning.

BRIEF SUMMARY OF THE INVENTION

The present invention is intended to solve the problem that when a preset length of time has elapsed, a variety of events may unexpectedly occur, resulting in extra labor and time before the start of image formation. Accordingly, an object of the present invention is to provide an image forming apparatus which prevents various events from undesirably starting on the basis of their preset times, and which therefore does not require extra labor or time before the start of image formation.

The present invention is also intended to solve the problem that unexpected occurrence of various events during image formation lengthens the time needed before the completion of the image formation, and also the problem that the image formation results may vary before and after the occurrence of an event. Accordingly, another object of the present invention is to provide an image forming apparatus which prevents unexpected occurrence of various events when image formation is being executed, thereby obviating extra time before the completion of the image formation, and which prevents image formation results from varying before and after the occurrence of an event, thereby allowing the image forming results to be as faithful possible to the user's intention.

An image forming apparatus according to the present invention is provided with an operation section with which a user enters designations, and an image formation section for forming an image on an image formation medium, and comprises: a memory to store a first period of time and a second period of time, the first period of time being defined between a point of time when a standby state, where the image formation section is ready to form an image is switched on and a point of time when an event is started, the second period of time being defined between the point of time when the standby state is switched on and the start of an advance notice of the execution of the event; a timer to measure a length of time starting from the point of time when the standby state is switched on; a display device to display a period of time left before the start of the event, when the length of time measured by the timer indicates the elapse of the second period of time and keep operating until the event is started; and a control section to reset the period of time measured by the timer, with the standby state maintained, when a designation is entered from the operation section in the state where the display device is displaying the period of time left before the start of the event, and to start the event when the first period of time has elapsed without no designation being entered from the operation section.

Another image forming apparatus according to the present invention is provided with an operation section with which a user enters designations, and an image formation section for forming an image on an image formation medium, and comprises: a memory to store a first period of time and a second period of time, the first period of time being defined between the end of a last event and the start of a next event, the second period of time being defined between the end of the last event and the start of a notice of the next event; a timer to measure a length of time starting from the end of the last event; a display device to display a period of time left before the start of the event, the display device being designed to start operating when the length of time measured by the timer indicates the elapse of the second period of time and keep operating until the event is started; and a control section to control a subsequently scheduled event to be executed after the end of image formation which is then being executed by the image formation section, when a cancel command for canceling the subsequently-scheduled event is entered from the operation section in the state where the display device is displaying the period of time left before the start of the event.

Still another image forming apparatus according to the present invention is provided with an operation section with which a user enters designations, and an image formation section for forming an image on an image formation medium, and comprises: a memory to store a first value and a second value, the first value representing the number of image formation mediums on which the image formation section forms an image between the point of time when a last event is executed and the point of time when a next event is started, the second value representing the number of image formation mediums on which the image formation section forms an image between the point of time when the last event is executed and the point of time when a notice of the next event is issued; a counter to count the number of image formation mediums on which the image formation section forms an image after the end of the last event; a display device to display the number of image formation mediums left unprocessed before the start of the next event, when the number of image formation mediums counted by the counter has reached the second value and keep operating until the next event is started; and a control section to control a subsequently-scheduled event to be executed after the end of image formation which is then being executed by the image formation section, when a cancel command for canceling the subsequently-scheduled event is entered form the operation section in the state where the display device is displaying the number of image formation-mediums left unprocessed before the start of the next event.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

An embodiment of the present invention will now be described with reference to the accompanying drawings.

Figure 1:
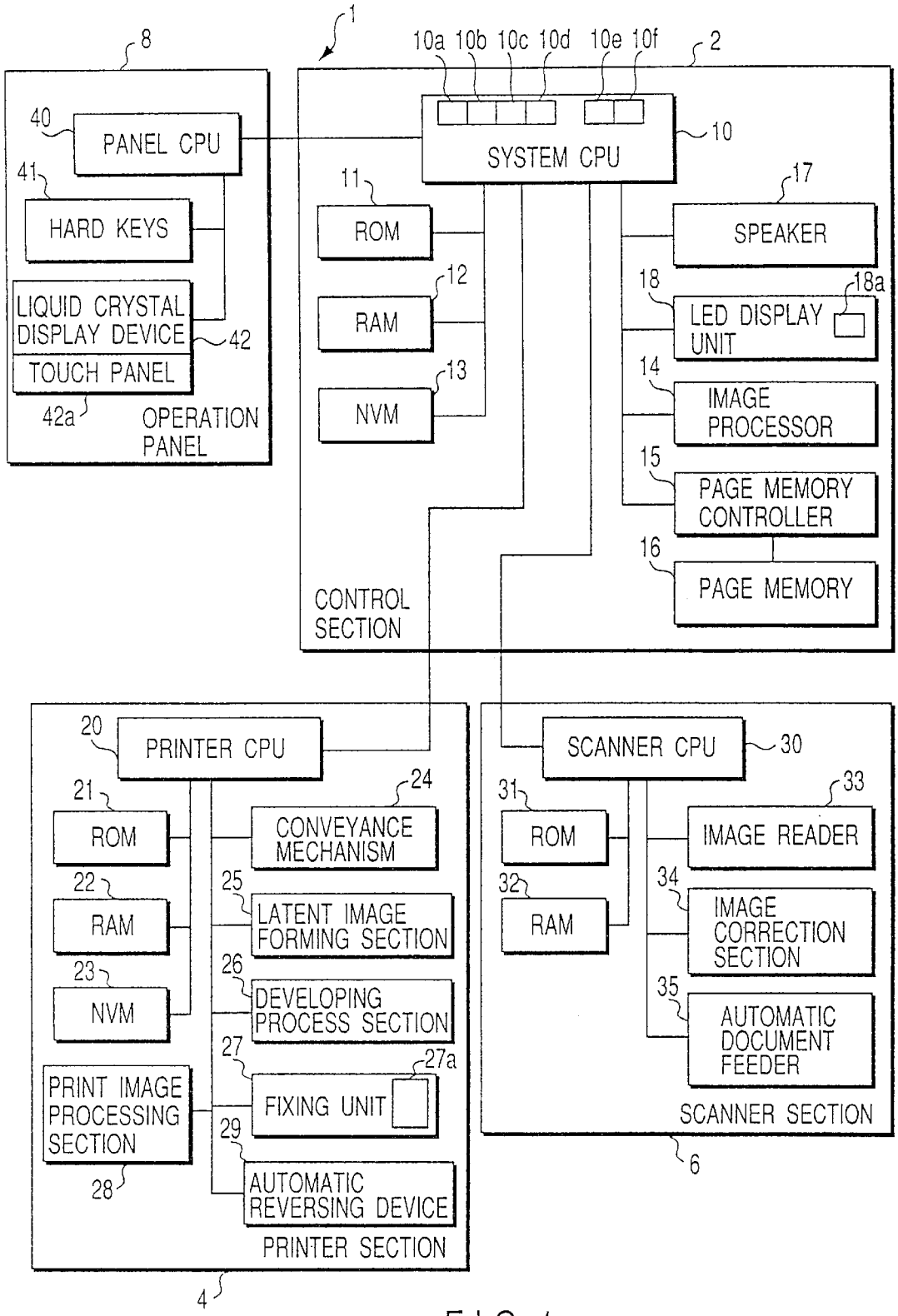
FIG. 1 is a schematic block diagram showing the entire digital copying machine, which is an embodiment of an image forming apparatus of the present invention.

FIG. 1 is a schematic block diagram illustrating how the structural components of the digital copying machine 1 (i.e., an image forming apparatus of the present invention) are connected together and how signals are exchanged for control.

As shown in FIG. 1, the digital copying machine 1 comprises a control section 2, a printer section 4, a scanner section 6, an operation panel 8, etc. The operation of the digital copying machine 1 is controlled by three CPUs, namely, a system CPU 10, a printer CPU 20 and a scanner CPU 30. The system CPU 10 is provided for the control section 2 to control the entire machine. The printer CPU 20 controls the printer section 4, which forms an image formation operation. The scanner CPU 30 controls the scanner section 6, which reads a document image. A panel CPU 40 is connected to the system CPU 10. The panel CPU 40 controls the entire operation panel 8 and has a function of providing the system CPU 10 with information as to how the user operates hard keys or LCD keys provided on the operation panel.

The system CPU 10 performs serial communication with reference to the printer CPU 20. The system CPU 10 sends operation commands to the printer CPU 20 and receives operation status signals therefrom. The printer CPU 20 executes operations on the basis of the operation commands from the system CPU 10 and simultaneously sends operation status signals to the system CPU 10.

Likewise, the system CPU 10 performs serial communication with reference to the scanner CPU 30. The system CPU 10 sends operation commands to the scanner CPU 30 and receives operation status signals therefrom. The scanner CPU 30 executes operations on the basis of the operation commands from the system CPU 10 and simultaneously sends operation status signals to the system CPU 10. In this manner, the operation states of the printer section 4 and scanner section 6 are supplied to the system CPU 10 as status information, and the system CPU 10 is thus allowed to monitor the operating conditions of all sections of the apparatus at all times. On the basis of the operating conditions of the entire apparatus and of input signals entered from the operation panel 8 and supplied to the panel CPU 40, the system CPU 10 controls the entire digital copying machine 1.

As shown in FIG. 1, the control section 2 of the digital copying machine 1 comprises a ROM 11, a RAM 12, an NVM 13, an image processor 14, a page memory controller 15, a page memory 16, speaker 17 and an LED display unit 18, as well as the system CPU 10 described above. These structural components are connected to the system CPU 10.

The system CPU 10 checks the operating states of the printer section 4 and scanner section 6 and controls the entire digital copying machine 1 on the basis of operation commands entered from the operation panel 8. The system CPU 10 controls the operations, including a copying operation, in units of one job. For example, when a copy is made from a plural-page document, the operation of reading a document image from the document by means of the scanner section is managed as one job, and the operation of printing the document image by means of the printer section 4 is managed as one job.

The ROM 11 stores various control programs and control data. The RAM 12 temporarily stores data. The NVM (a nonvolatile access memory) 13 is a nonvolatile memory backed up by a battery (not shown) and retains data even when the power supply is turned off. The NVN 13 stores various setting variables.

The image processor 14 executes image processing, such as the compression or expansion of image data. The page memory controller 15 records or reads image data from the page memory 16. The speaker 17 is incorporated inside the digital copying machine 1 and generates a beep, which is sounds like a buzzer, and serves as a warning to the user. The LED display unit 18 flickers an LED 18*a*, which is provided for the digital copying machine 1 at a position that can be easily looked at by the user.

The system CPU 10 incorporates timers 10*a*–10*d* and counters 10*e* and 10*f*. Timers 10*a* and 10*c* count up the time from the point of time when they are reset by the system CPU 10, while timers 10*b* and 10*d* count down the time from the point of time set by the system CPU 10. Counter 10*e* counts up the number of copy sheets on which the printer section 4 prints an image, while counter 10*f* counts down the value set by the system CPU 10 each time the printer section 4 prints an image on a copy sheet.

As shown in FIG. 1, the printer section 4 comprises a ROM 21, a RAM 22, an NVM 23, a conveyance mechanism 24, a latent image forming section 25, a developing process section 26, a fixing unit 27, an print image processing section 28, an automatic reversing device 29, etc, as well as the printer CPU 20 described above. These structural elements are connected to the printer CPU 20.

Under the control of the system CPU 10, the printer CPU 20 controls the conveyance mechanism 24, latent image forming section 25, developing process section 26, fixing unit 27, print image processing section 28, and automatic reversing device 29. The ROM 21 stores various control programs and control data. The RAM 22 temporarily stores data. The NVM (a nonvolatile access memory) 23 is a nonvolatile memory backed up by a battery (not shown).

The conveyance mechanism 24 takes out copy sheets (i.e., image formation mediums) from a storage section (not shown) one by one. The latent image forming section 25 controls a semiconductor laser (not shown) in such a manner that an electrostatic latent image corresponding to an image read by the scanner section 6 is formed on a photosensitive drum (not shown). The developing process section 26 supplies a developer (toner) to the electrostatic latent image formed on the photosensitive drum, and transfers the resultant developer image onto a copy sheet. The fixing unit 27 melts and fixes the developer image that has been transferred to the copy sheet by the developing process section 26. The fixing unit 27 is provided with a heat roller 27*a*, a fan, etc. The heat roller 27*a* heats and fixes the developer image to the copy sheet by applying heat and pressure to the image. The fan is used to remove heat, which may be generated by the fixing unit, from the apparatus.

The print image processing section 28 processes an image to be printed. The automatic reversing device 29 enables an image to be printed on each side of a copy sheet. That is, when an image is formed on one side of the copy sheet, the automatic reversing device 29 reverses the sheet and feeds the sheet once again to the developing process section 26 and the fixing unit 27.

As shown in FIG. 1, the scanner section 6 comprises a ROM 31, a RAM 32, an image reader 33, an image correction section 34 and an automatic document feeder (ADF) 35 as well as the scanner CPU 30 described above. These structural components are connected to the scanner CPU 30.

The scanner CPU 30 controls the entire scanner device 6. Under the control of the system CPU 10, the scanner CPU 30 controls the image reader 33, the image correction section 34 and the ADF 35. The ROM 31 stores various control programs and control data. The RAM 32 temporarily stores data.

The image reader 33 is made up of an exposure lamp for irradiating a document with light, a photoelectric conversion element for converting light into electric signals, etc. The image reader 33 optically reads a document image and produces image data in the form of electric signals. The image correction section 24 performs correction or other kind of processing with respect to the document image read by the image reader 33. The automatic document feeder 35 feeds documents to a predetermined read position one by one.

The page memory 16, the print image processing section 25 and the image reader 33 are connected together by means of an image data bus (not shown), and image data is exchanged between them.

As shown in FIG. 1, the operation panel 8 comprises hard keys 41 and a liquid crystal display device (LCD) 42, as well as the panel CPU 40 to which they are connected. The hard keys include 41 a start key, a power save key, a ten-key pad, and other hard keys. The liquid crystal display device 42 displays an operation guide to the user. The liquid crystal display device 42 incorporates a touch panel 42a, and this touch panel 42a displays LCD keys.

Figure 2:
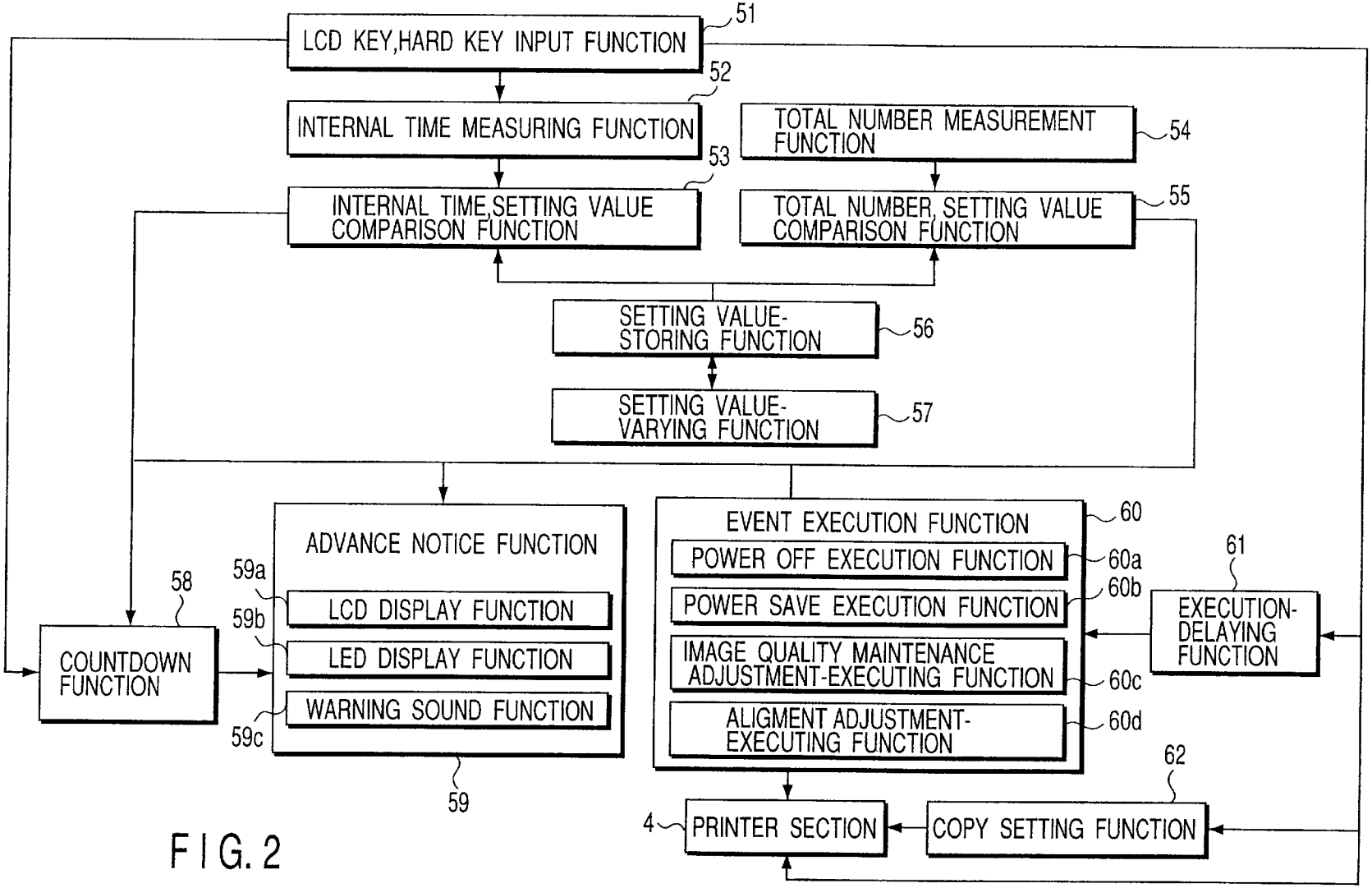
FIG. 2 is a block diagram illustrating the functions a control section has.

FIG. 2 is a block diagram illustrating the functions of -the control section 2. The control section 2 has the following functions realized under the control by the system CPU 10: a key input function 51; a time measuring function 52; a time comparison function 53; a number measurement function 54; a number comparison function 55; a setting value-storing function 56; a setting value-varying function 57; a countdown function 58; an advance notice function 59 (including an LCD display function 59*a*, an LED flickering function 59*b* and a warning sound function 59*c*); an event execution function 60 (including a power off execution function 60*a*, a power save execution function 60*b*, an image quality maintenance adjustment execution function 60*c*, and an alignment adjustment execution function 60*d*); a copy setting function 61; an event execution-delaying function 62; etc.

When the hard keys 41 of the operation panel 8 or when the LCD keys displayed on the touch panel 42*a* of the liquid crystal display device 42 are operated, the key input function 51 enables the system CPU 10 to grasp the operation contents supplied from the panel CPU 40.

The time measuring function 52 is a function of measuring time by counting up by means of timers 10*a* and 10*c* provided inside the system CPU 10. The number measurement function 54 counts the number of copy sheets on which image formation processing has been executed (i.e., the number of copies). This count operation is performed by the count-up operation by counter 10*e* of the system CPU 10.

The setting value-storing function 56 is a function of storing various setting values in the NVM 13. The setting value-varying function 57 is a function of varying the setting values stored in the NVM 13. The setting values, which are defined by the setting value-storing function 56 and the setting value-varying function 57, can be entered from the operation panel 8. When the setting values are stored or varied, an automatic diagnosis setting mode is selected in which various settings can be made. In this automatic diagnosis setting mode, a desired setting value is entered. The user may select the automatic diagnosis setting mode; alternatively, it may be selectable only by a service person (a maintenance person) having a special knowledge in the art.

The time comparison function 53 is a function of comparing setting values with the times counted up by use of the time measuring function. The setting values are values which represent the start times of events, such as "auto power off", "auto power save", "automatic image quality maintenance adjustment", "automatic alignment adjustment", etc., and which are stored by use of the setting value-storing function 56.

The number comparison function 55 is a function of comparing a setting value with the number counted up by use of the number measurement function 54. The setting value represents a standard value for determining whether to execute the automatic image quality maintenance adjustment or automatic alignment adjustment, and this setting value is determined by use of the setting value-storing function 56. The countdown function 58 is a function of counting down the time from the values set in timers 10*b* and 10*d* of the system CPU 10; alternatively, it is a function of counting down the number of copies from the value set in counter 10*f* of the system CPU 10.

The advance notice function 59 is a function of notifying the user of events before the events are executed. The events include "auto power off", "auto power save", "automatic image quality maintenance adjustment", "automatic alignment adjustment", etc. The advance notice function 59 is executable as the LCD display function 59*a*, the LED flickering function 59*b*, the warning sound function 59*c*, or the like.

The LCD display function 59*a* is a function used when there is an event to be executed. By this function 59*a*, the LCD 42 displays and counts down the time or number of copies left before the execution of an event. The time or number of copies counted down is based on the times counted down by timers 10*b* and 10*d* or the number of copies counted down by counter 10*f* by use of the countdown function 58.

The LED flickering function 59*b* is a function of notifying the use of an event to be executed by controlling the LED display device 18 to flicker the LED 18*a*. The warning sound function 59*c* is a function of notifying the use of an event to be executed by controlling the speaker 17 to generate a warning sound (e.g., a beep sound).

Whether or not to execute the LCD display function 59*a* LED flickering function 59*b*, and warning sound function 59*c*, each of which is one form of the advance notice function 59, can be determined in the self-diagnosis setting mode described above. For example, the LCD display function 59*a* may be normally in the ON state, and the LED flicking function 59*b* and the warning sound function 59*c* may be selectively set in the ON or OFF state. Even when the LED flicking function 59*a* is ON, the user may not become aware of the flickering LED if he or she is located at such an angle that does not enable the display screen to be looked at entirely or easily. Even the user at such a location never fails to be warned, and the execution of the event is reliably known in advance. When the warning sound function 59*c* is ON, even the user who does not see the main body of the digital copying machine can be warned with the warning sound. In this manner, the execution of the event is known to every user in advance.

The event execution function 60 is a function of actually executing events, such as "auto power off", "auto power save", "automatic image quality maintenance adjustment" or "automatic alignment adjustment" (this function is specifically referred to as the power off 4 execution function 60*a*, power save execution function 60*b*, image quality maintenance adjustment-executing function 60*c*, or alignment adjustment-executing function 60*d*).

The power off execution function 60*a* is a function of automatically turning off the main power supply to the digital copying machine 1 if no operation is performed within the predetermined period of time after the printer section 4 ends the print operation, i.e., if the copy standby state of the digital copying machine continues for the predetermined period of time.

The power save execution function 60*b* is a function of automatically switching off the digital copying machine 1 into a power save mode if no operation is performed within the predetermined period of time after the printer section 4 ends the print operation, i.e., if the copy standby state of the digital copying machine continues for the predetermined period of time.

In this power save mode, the amount of power consumed by the digital copying machine in the copy standby state is made as small as possible. In other words, the power save mode is a mode in which the power supplies other than the absolutely required ones are turned off or applied with reduced power. For example, in the power save mode, the power consumption is reduced by turning off the power supply to the fixing unit 27 since its heat roller 27*a* consumes a large amount of power even in the copy standby state. When the digital copying machine 1 is switched back to the copy standby state from the power save mode, a startup operation, such as the warming up operation of the fixing unit 27, has to be performed. The power save mode is canceled by operating the "START" key (not shown) of the operation panel 8. When the power save mode is canceled, the digital copying machine 1 first performs the startup operation and then enters into the copy standby state.

The image quality maintenance adjustment-executing function 60*c* is a function of automatically making adjustment for maintaining the image quality when a predetermined period of time has elapsed from the last image quality maintenance adjustment operation or when printing has been performed on a preset number of sheets. By the image quality maintenance adjustment, the image quality, which may deteriorate with time or in accordance with an increase in the number of sheets processed, is kept in the desirable state. For example, color printing, which uses several kinds of ink, including yellow, cyan, magenta and black, is likely to undergo variations in color tone with time or in accordance with an increase in the number of sheets printed. To maintain a desirable image quality, therefore, an image quality maintenance adjustment is made on a regular basis.

The alignment adjustment-executing function 60*d* is a function of automatically making alignment adjustment when a predetermined period of time has elapsed from the last image quality maintenance adjustment operation or when printing has been performed on a preset number of sheets, as in the case of the image quality maintenance adjustment. The alignment adjustment corrects the image position, which may be shifted with time or in accordance with an increase in the number of sheets processed. For example, color printing, which uses several kinds of ink, including yellow, cyan, magenta and black, is likely to undergo variations in color print position with time or in accordance with an increase in the number of sheets printed. To maintain a desirable color print position, therefore, an alignment adjustment is made on a regular basis.

The event execution-delaying function 61 is a function of delaying an event executed by use of the event execution function 60. The copy setting function is a function of determining a variety of settings for copies that are produced by the printer section 4 and scanner section 6.

A description will now be given of the auto power off function and the auto power save function of the digital copying machine 1.

Figure 3:
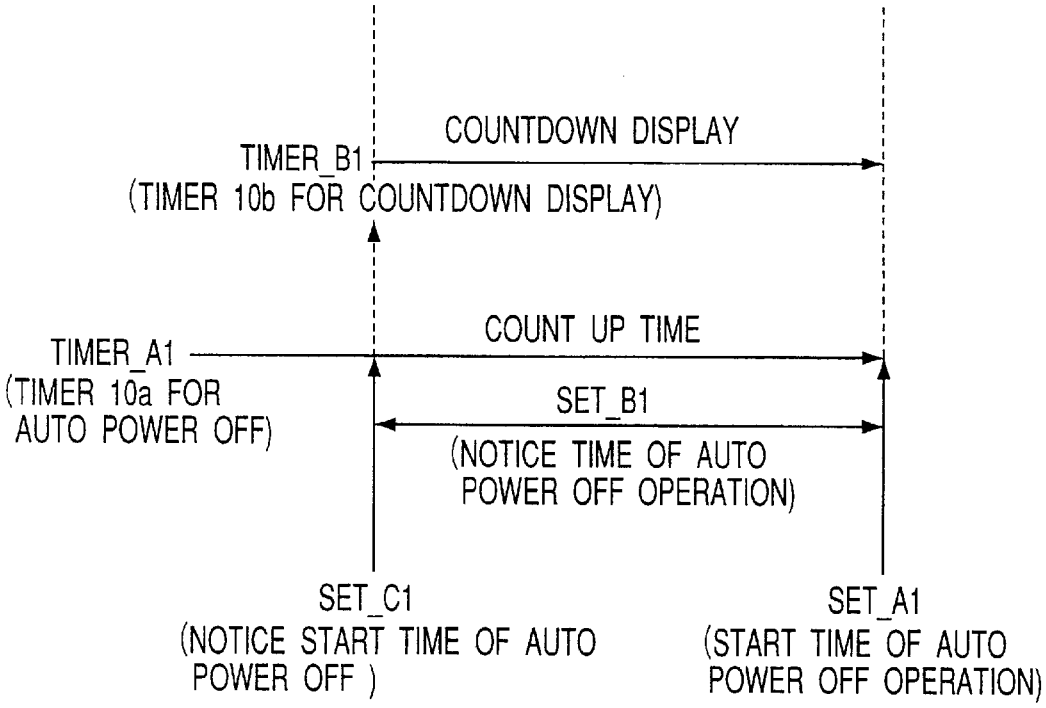
FIG. 3 is a timetable illustrating the times related to auto power off function.

FIG. 3 is a timetable illustrating the times related to the auto power off function. As shown in FIG. 3, the auto power off operation is controlled on the basis of the following: the start time (SET_A1) for starting the auto power off operation; the notice time (SET_B1) during which the countdown display is continued for making an advance notice of the auto power off operation; and the notice start time (SET_C1) for starting the advance notice of the auto power off operation.

The start time (SET_A1) is a point of time when the auto power off operation is started, and is set in the self-diagnosis setting mode. The notice time (SET_B1) represents the length of time for which the advance notice of the auto power off operation is continuously performed, and is set in the self-diagnosis setting mode. When the advance notice of the auto power off operation is given, a countdown message is kept displayed for the length of time represented by the notice time (SET_B1). The notice start time (SET_C1) is a point of time when the advance notice of the auto power off operation is started, and is computed by the system CPU 10 on the basis of the start time (SET_A1) and the start time (SET_B1).

The system CPU 10 is provided with timer 10*a* for counting up time (TIMER_A1) and timer 10*b* for counting down time (TIMER_B1). Unless the main body is in an error state, timer 10*a* starts counting up time (TIMER_A1) when the last print operation has ended and a user's key operation is performed last. This counting-up operation continues until the hard keys 41 or the LCD keys on the touch panel 42*a* are operated. As can be seen from this, the system CPU 10 resets the value of timer 10*a* (TIMER_A1=0) and causes it to start time measurement when the main body of the digital copying machine 1 has entered into the copy standby state. When a key operation by the user is performed, the system CPU 10 stops the time measurement by timer 10*a*.

Timer 10*b* counts down time (TIMER_B1) from the point of time when the advance notice of the auto power off operation is started and continues its countdown operation until the start time of the auto power off operation. To start the advance notice of the auto power off operation, a notice start time (SET_C1) is set for timer 10*b*, and timer 10*b* counts down the time in accordance with the lapse of time. When the start time of the auto power off operation comes, the count of timer 10*b* (TIMER_B1) is "0", and the main power supply to the main body is turned off by the system CPU 10.

In the example described above, the advance notice of the auto power off operation is controlled by use of two timers, namely, timers 10*a* and 10*b*. Instead of this, only one of the timer for counting up and the timer for counting down may be used for controlling the operation. For example, in the case where the operation is controlled by employing the timer for counting down, the countdown operation is started when the copy standby state has been set, and is continued until the start time of the auto power off operation. When the counted-down time indicates the arrival of the notice time, the advance notice of the power off operation is given. In this manner, the operation can be controlled by employing only one timer.

In the above description, reference was made to the timetable of the auto power off operation. In the case of the auto power save, a timetable similar to that shown in FIG. 3 is applicable, and an operation control for advance notice can be performed based on such a timetable.

Figure 4:
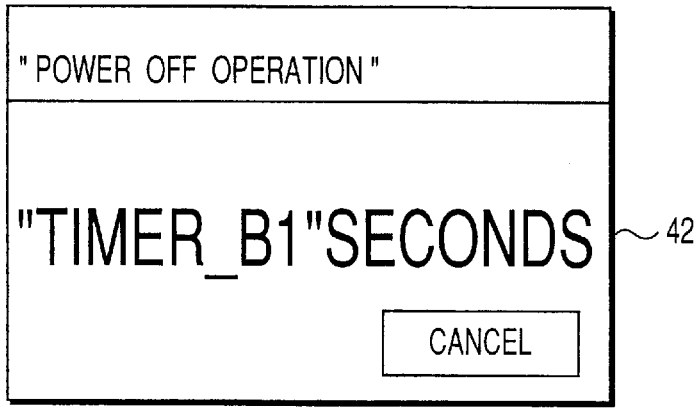
FIG. 4 shows an example of a message which a liquid crystal display device displays to notify the user of entry into the auto power off mode in advance.

FIG. 4 shows an example of a message which the LCD 42 displays to notify the user of entry into the auto power off mode in advance. As shown in FIG. 4, the advance notice of the auto power off operation is given by causing the LCD 42 to display the message "'POWER OFF OPERATION' SCHEDULED", as well as the message ("'TIMER_B1' SECONDS") indicating how many seconds are left before the power off operation. The LCD 42 also displays "CANCEL" key which is provided as a key on the touch panel 42*a* and which enables entry of a designation.

Let us assume that the user comes to the digital copying machine 1 to make a copy immediately before the auto power off operation, and that the display message shown in FIG. 4 is indicated on the LCD 42 then. If the user does not do anything in such a situation, the main power supply to the digital copying machine 1 is turned off when the remaining time displayed on the LCD 42 becomes "0." If the main power supply is turned off, the time for the warning up operation is required before the digital copying machine 1 is ready for printing. To avoid this inconvenience, when the user comes to the digital copying machine 1 to make a copy and finds the display message shown in FIG. 4, the user presses the "CANCEL" key. Owing to this, the power supply to the digital copying machine is prevented from switching into the OFF state even when the user is in front of the digital copying machine.

In the case described above, reference was made to the case where the advance notice of the auto power off operation was displayed. In the case where the present invention is applied to the advance notice of the auto power save, a display screen similar to that shown in FIG. 4 can be indicated as an advance notice message. In the case of the advance notice of the auto power save, however, the guide message "'POWER OFF OPERATION' SCHEDULED" is replaced with the "SWITCHING TO POWER SAVE MODE", the time that is left before the switching to the power save mode is displayed and counted down. In this case as well, the auto power save function does not undesirably bring the digital copying machine into the power save mode when the user is in front of the digital copying machine.

A description will now be given as to how the auto power off operation is performed.

Figure 5:
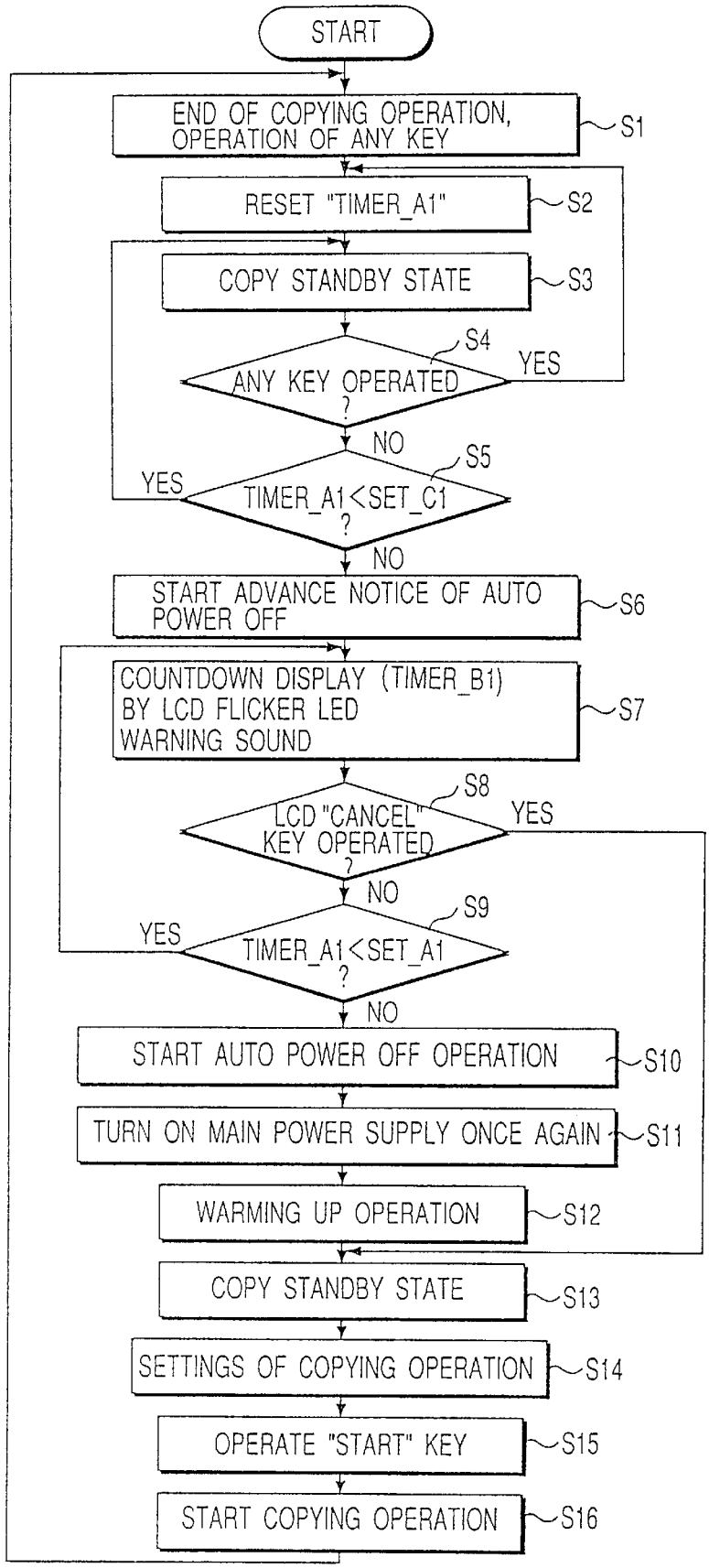
FIG. 5 is a flowchart illustrating the auto power off operation.

FIG. 5 is a flowchart illustrating the auto power off operation.

The system CPU 10 checks whether the last sheet has been discharge in a printing operation or if the hard keys 41 or LCD keys, which are other than the "START" key and "POWER SAVE" key, are operated (Step S1). When this state is detected, the system CPU 10 resets the value (TIMER_A1) of timer 10*a* to "0" and starts counting up time (Step S2). The system CPU 10 sets the entire digital copying machine 1 in the copy standby state, and controls the LCD 42 of the operation panel 8 to indicate the copy standby state (Step S3).

Unless a key operation by the user is performed, this copy standby state continues until the arrival of the preset start time (SET_A1) of the auto power off operation. When, in this copy standby state of the digital copying machine, the user operates the hard keys 41 or LCD keys, which are other than the "START" key and "POWER SAVE" key, ("YES" in Step S4), the system CPU 10 returns to step S2 and resets the value (TIMER_A1) of timer 10*a* to "0."

When the "START" key is operated, the system CPU 10 resets timer 10*a* and starts copying processing. When the "POWER SAVE" key is operated, the system CPU 10 resets timer 10*a* and executes processing for switching into the power save mode.

If none of the hard keys 41 or LCD keys are operated in the copy standby state ("NO" of step S4), the system CPU 10 compares the value (TIMER_A1) of timer 10*a* with the notice start time (SET_C1) of the auto power off operation, so as to determine whether or not "SET_C1" is greater than "TIMER_A1" (Step S5).

If this determination shows that the notice start time (SET_C1) is greater than the value (TIMER_A1) of timer 10*a* ("YES" in Step S5), the system CPU 10 returns to step S3, and the same processing is repeated.

If it is not determined that the notice start time (SET_C1) is greater than the value (TIMER_A1) of timer 10*a* ("NO" in Step S5), the system CPU 10 starts an advance notice of the auto power off operation (event) (Step S6). The advance notice of this auto power off operation is carried out on the basis of the contents determined in the automatic diagnosis-setting mode. That is, the system CPU 10 causes the LCD 42 to display and count down the time (TIMER_B1) remaining before the start of the auto power off operation. In addition, on the basis of the settings, the system CPU 10 controls the LED display unit 18 to flicker the LED 18*a* or controls the speaker 17 to generate a warning sound (Step S7).

During the execution of this advance notice, the system CPU 10 checks whether or not the "CANCEL" key of the display screen of the LCD 42 shown in FIG. 4 has been operated (Step S8). If this determination shows that the "CANCEL" key has not been operated ("NO" in Step S8), the system CPU 10 compares the value (TIMER_A1) of timer 10*a* with the start time (SET_A1) of the auto power off operation, so as to determine whether or not "SET_A1" is greater than "TIMER_A1" (Step S9).

If this determination shows that the start time (SET_A1) of the auto power off operation is greater than the value (TIMER_A1) of timer 10*a* ("YES" in Step S9), then the system CPU 10 returns to Step S7, and continues the advance notice.

Conversely, if the determination does not show that the start time (SET_A1) of the auto power off operation is greater than the value (TIMER_A1) of timer 10*a* ("NO" in Step S9), the system CPU 10 starts the auto power off operation (Step S10). In this manner, the main power supply to the entire digital copying machine 1 is turned off.

To execute a copying operation after the main power supply is turned of f, the user turns on the main power supply once again (Step S11). In response to the main power supply being turned on, the system CPU 10 executes the startup operation, such as the warming up operation for the fixing unit 27, so as to switch into the copy standby state (Step S12). When this startup A operation comes to an end, the digital copying machine 1 is set in the copy standby state, in which it is ready to execute a copying operation (Step S13). After the digital copying machine is set in the copy standby state, the system CPU 10 makes settings for the copy mode in accordance with the designations entered by the user (Step S14).

After the settings are made for the copy mode, the system CPU 10 checks whether or not the "START" key has been operated by the user (Step S15). In response to the operation of the "START" key, the copying operation is started (Step S16). At the end of the copying operation, the system CPU 10 returns to Step Si, and the processing described above is repeated.

If it is determined in Step S8 that the "CANCEL" key is operated during the advance notice, the system CPU 10 resets the value of timer 10*a*, and then advances to Step S13. In this step, the digital copying machine 1 is set in the copy standby state.

In the above, the operation regarding the advance notice of the auto power off operation was described. The operation regarding the advance notice of the auto power save operation is performed in a similar manner to that described above.

As described above, the user is notified of the auto power off operation or auto power save operation before it is executed. Owing to this advance notice, the digital copying machine is not turned off or switched into the power save mode contrary to the user's intention. Accordingly, no extra labor or time is imposed on the user.

A description will now be given of the automatic image quality maintenance operation or automatic alignment adjustment which the above-mentioned digital copying machine 1 performs. In the description below, reference will be made to the advance notice of the automatic image quality maintenance adjustment, but the advance notice of the automatic alignment adjustment can be made in a similar manner to that of the automatic image quality maintenance adjustment.

There are two manners in which the automatic mage quality maintenance adjustment and the automatic alignment adjustment are executed. One manner is to execute them on the basis of the time for which the digital copying machine has been used; and the other is to execute them on the basis of the number of copy sheets that have been printed by the printer section 4 (i.e., the number of copies made).

First, the automatic image quality maintenance adjustment based on the time of use will be described.

Figure 6:
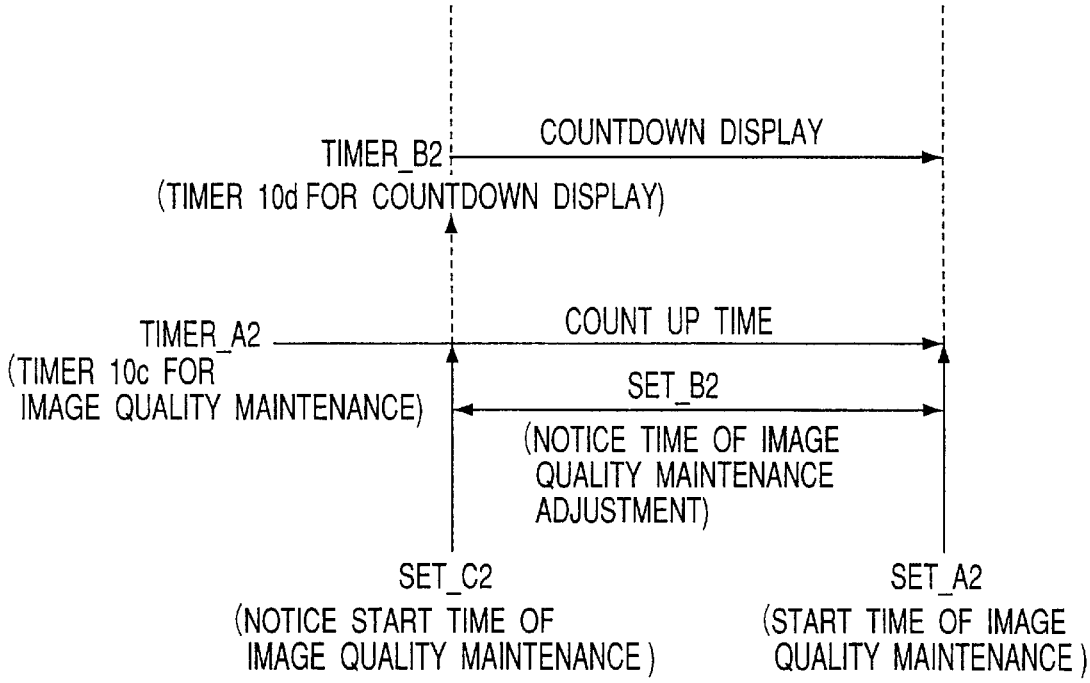
FIG. 6 is a timetable illustrating an automatic image quality maintenance function.

FIG. 6 is a timetable illustrating the times used for the automatic image quality maintenance adjustment. As shown in FIG. 6, the automatic image quality maintenance adjustment is controlled on the basis of the following: the start time (SET_A2) for starting the automatic image quality maintenance adjustment; the notice time (SET_B2) during which the countdown display is continued for making an advance notice of the automatic image quality maintenance adjustment; and the notice start time (SET_C2) for starting the advance notice of the automatic image quality maintenance adjustment.

The start time (SET_A2) is a point of time when the automatic image quality maintenance adjustment is started, and is set in the self-diagnosis setting mode. The notice time (SET_B2) represents the length of time for which the advance notice of the automatic image quality maintenance adjustment is continuously performed, and is set in the self-diagnosis setting mode. When the advance notice of the auto power off operation is performed, a countdown message is kept displayed for the length of time represented by the notice time (SET_B2). The notice start time (SET_C2) is a point of time when the advance notice of the automatic image quality maintenance adjustment is started, and is computed by the system CPU 10 on the basis of the start time (SET_A2) and the start time (SET_B2).

The system CPU 10 is provided with timer 10*c* for counting up time (TIMER_A2) and timer 10*d* for counting down time (TIMER_B2). Timer 10*c* starts measurement from the time (TIMER_A2) when the last image quality maintenance adjustment (event) is ended. In other words, when the image quality maintenance adjustment is made, the system CPU 10 resets the count of timer 10*c* (TIMER_A2=0) and causes timer 10*c* to start time measurement.

On the other hand, timer 10*d* counts down time (TIMER_B2) from the point of time when the advance notice of the automatic image quality maintenance adjustment is started and continues its countdown operation until the start time of the image quality maintenance adjustment. To start the advance notice of the automatic image quality maintenance adjustment, a notice start time (SET_C2) is set for timer 10*d*, and timer 10*d* counts down the time in accordance with the lapse of time. When the start time of the automatic image quality maintenance adjustment comes, the time (TIMER_B2) counted down by timer 10*d* becomes "0", and the system CPU 10 starts execution of the image quality maintenance adjustment.

In the example described above, the control is executed by use of two timers, namely, timers 10*c* and 10*d*. Instead of this, only one of the timer for counting up and the timer for counting down may be used for controlling the operation. For example, in the case where the operation is controlled by employing the timer for counting down, the countdown operation is started when the last automatic image quality maintenance adjustment has ended, and is continued until the start time of the next automatic image quality maintenance adjustment. When the counted-down time indicates the arrival of the notice time, the advance notice of the power off operation is performed. In this manner, the operation can be controlled by employing only one timer.

In the above description, reference was made to the timetable of the automatic image quality maintenance adjustment. In the case of the automatic alignment adjustment, a timetable similar to that shown in FIG. 6 is applicable, and an operation can be performed based on such a timetable.

Figure 7:
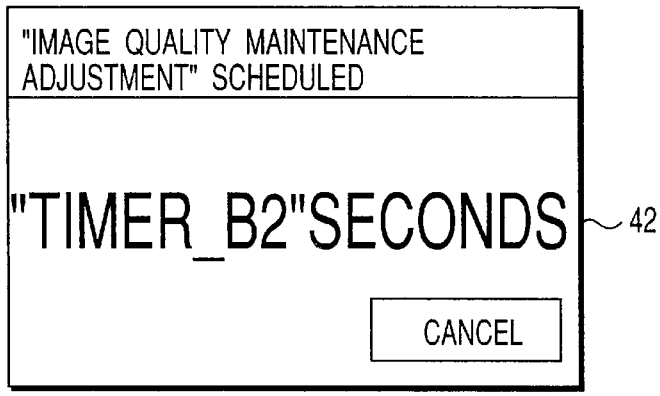
FIG. 7 shows an example of a message which the liquid crystal display device displays to notify the user of entry into the automatic image quality maintenance adjustment mode in advance.

FIG. 7 shows an example of a message which the LCD 42 displays to notify the user of the image quality maintenance adjustment in advance. As shown in FIG. 7, the advance notice of the image quality maintenance adjustment is made by causing the LCD 42 to display the message "'IMAGE QUALITY MAINTAINING ADJUSTMENT' SCHEDULED", as well as the message ("'TIMER_B2' SECOND") indicating how many seconds are left before the image quality maintenance adjustment. The LCD 42 also displays "CANCEL" key which is provided as a key on the touch panel 42*a* and which enables entry of a designation.

Let us assume that the user comes to the digital copying machine 1 to make a copy immediately before start of the automatic image quality maintenance adjustment, and that the display message shown in FIG. 7 is indicated on the LCD 42 then. If the user does not do anything in such a situation, the digital copying machine 1 starts the image quality maintenance adjustment when the remaining time displayed on the LCD 42 becomes "0." Once the image quality maintenance adjustment is started, the copying function is not available until the image quality maintenance adjustment comes to an end. To avoid this inconvenience, when the user comes to the digital copying machine 1 to make a copy and finds the display message shown in FIG. 7, the user presses the "CANCEL" key. By this operation, the image quality maintenance adjustment can be made after the end of the copying operation the user wants to execute first. Hence, the user does not have to wait for the completion of the image quality maintenance adjustment operation.

If an image quality maintenance adjustment is made during a copying operation executed for a plurality of pages, the quality of the images printed on copy sheets may differ before and after the image quality maintenance operation. Furthermore, if the image quality maintenance adjustment is made during a copying operation executed for a plurality of pages, the copying operation is temporarily interrupted, and is resumed after the completion of the image quality maintenance operation. In this case, the time between the start and end of the copying operation is inevitably lengthened in accordance with the period of time required for the image quality maintenance operation. To avoid this inconvenience, the image quality maintenance adjustment can be made after the completion of the copying operation in response to the user's designation.

By way of example, let us assume that the display screen (such as that shown in FIG. 7) representing the advance notice of the image quality maintenance adjustment operation is shown during a copying operation executed for a plurality of pages. If, in this case, the user operates the "CANCEL" key, the image quality maintenance adjustment during the copying operation is avoided. In other words, the image quality maintenance adjustment is executed after the completion of the ongoing copying operation. Hence, the image quality maintenance adjustment during the copying operation, which is contrary to the user's intention, is not executed, and the image quality of print results does not vary before and after the image quality maintenance operation. In addition, the time required before the completion of the copying operation does not become long.

In the case described above, reference was made to the case where the advance notice of the image quality maintenance adjustment was displayed. In the case where the present invention is applied to the advance notice of the automatic alignment adjustment, a display screen similar to that shown in FIG. 7 can be indicated as an advance notice. In the case of the advance notice of the automatic alignment adjustment, however, the guide message "'IMAGE QUALITY MAINTAINING ADJUSTMENT' SCHEDULED" is replaced with the "'AUTOMATIC ALIGNMENT ADJUSTMENT' SCHEDULED", the time that is left before the start of the alignment adjustment is displayed and counted down.

Figure 8:
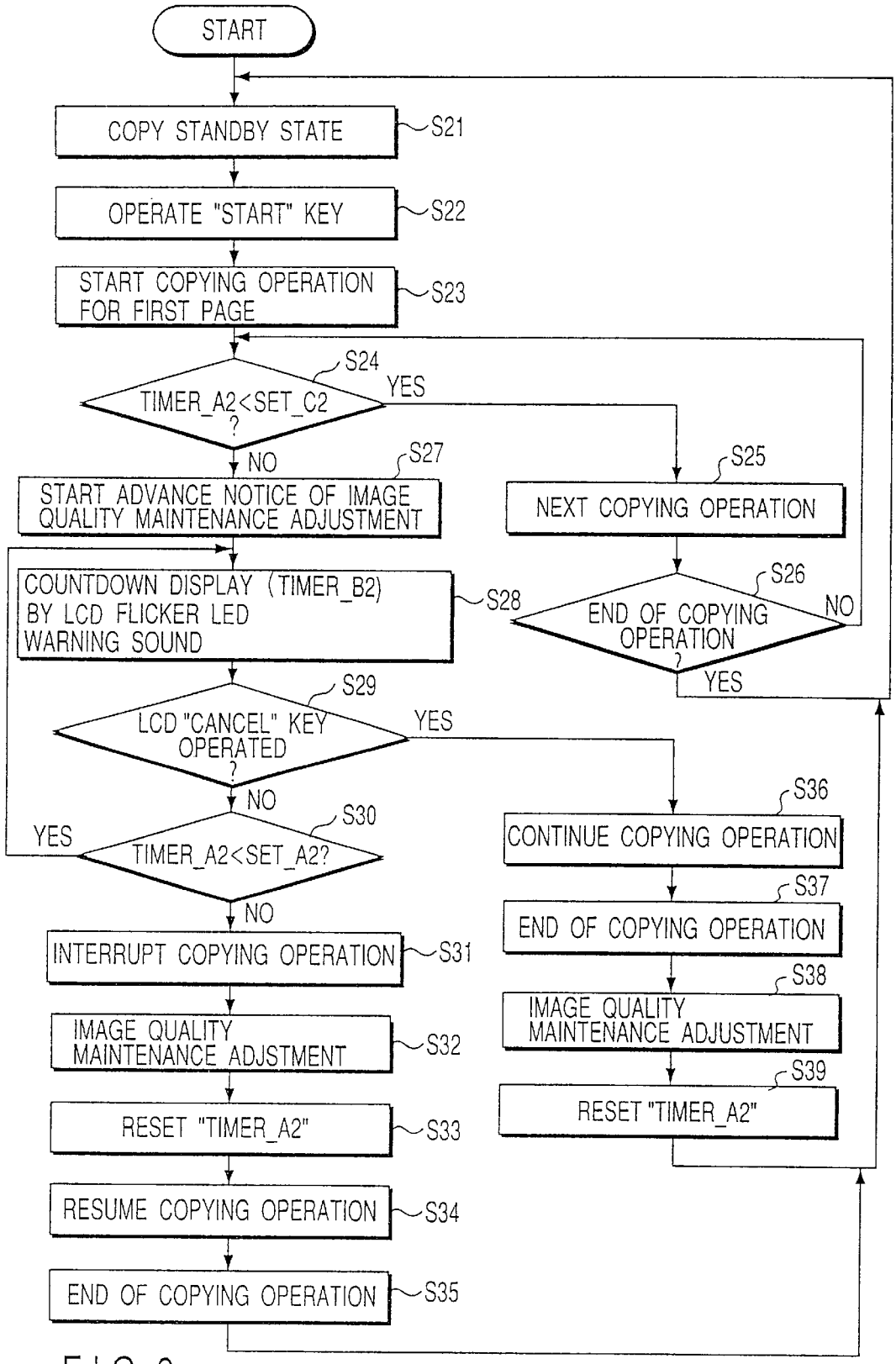
FIG. 8 is a flowchart illustrating the operation of the automatic image quality maintenance adjustment.

FIG. 8 is a flowchart illustrating how the advance notice of the automatic image quality maintenance adjustment is started during the copying operation.

Let us assume that the digital copying machine 1 is in the copy standby state (Step S21) and that the user places a plural-page document on the ADF 35 and operates the "START" key (Step S22). In response, the system CPU 10 starts a copying operation (Step S23). The system CPU 10 manages, as one job, the copying processing for the document the user places on the ADF 35.

At the outset of the copying operation, the system CPU 10 compares the value (TIMER_A2) of timer 10*c* with the notice start time (SET_C2) of the automatic image quality maintenance adjustment, so as to determine whether or not "SET_C2" is greater than "TIMER_A2" (Step S24).

If this determination shows that the notice start time (SET_C2) of the automatic image quality maintenance adjustment is greater than the value (TIMER_A2) of timer 10*c* ("YES" in Step S24), then the system CPU 10 continues the copying operation (Step S25). When the copying operation comes to an end ("YES" in Step S26), the system CPU 10 returns to step S21 and the machine is set in the copy standby state. If the copying operation has not yet been completed ("NO" in step S26), the system CPU 10 returns to Step S24 to compare "TIMER_A2" with "SET_C2."

Conversely, if the determination does not show that the notice start time (SET_C2) of the automatic image quality maintenance adjustment is greater than the value (TIMER_A2) of timer 10*c* ("NO" in Step S24), the system CPU 10 starts the advance notice of the automatic image quality maintenance adjustment (Step S27). The advance notice of this automatic image quality maintenance adjustment is carried out on the basis of the contents determined in the automatic diagnosis-setting mode. That is, the system CPU 10 causes the LCD 42 to indicate the time remaining before the start of the image quality maintenance adjustment as countdown time (TIMER_B2). In addition, on the basis of the settings, the system CPU 10 controls the LED display unit 18 to flicker the LED 18*a* or controls the speaker 17 to generate a warning sound (Step S28).

During the execution of this advance notice, the system CPU 10 checks whether or not the "CANCEL" key of the display screen of the LCD 42 shown in FIG. 4 has been operated (Step S29). If this determination shows that the "CANCEL" key has not been operated ("NO" in Step S29), the system CPU 10 compares the value (TIMER_A2) of timer 10*c* with the start time (SET_A2) of the automatic image-maintenance adjustment (the data on the start time being stored in the NVM 13).

On the basis of the results of this comparison, it is determined if the start time (SET_A2) of the automatic image quality maintenance adjustment is greater than the value (TIMER_A2) of timer 10*c* (Step S30). If it is determined that the start time (SET_A2) of the automatic image quality maintenance adjustment is greater than the value (TIMER_A2) of timer 10*c* ("YES" in Step S30), then the system CPU 10 returns to Step S28, and continues the advance notice.

If the determination does not show that the start time (SET_A2) of the automatic image quality maintenance adjustment is greater than the value (TIMER_A2) of timer 10*c* ("NO" in Step S30), the system CPU 10 interrupts the copying operation that is then being executed (Step S31), and starts the image quality maintenance adjustment (Step S32).

In this manner, if the key for canceling the image quality maintenance adjustment is not operated in spite of the advance notice of the adjustment, and when the start time of that adjustment comes, the system CPU 10 interrupts the ongoing job and executes the image quality maintenance adjustment.

When this image quality maintenance adjustment comes to an end, the system CPU 10 resets the value (TIMER_A2) of timer 10*c* and causes it to newly start time measurement (Step S33). In addition, the system CPU 10 resumes the interrupted copying operation (Step S34). When the copying operation is completed (Step S35), the control returns to step S21, and the operation described above is repeated.

If the determination in step S29 indicates that the "CANCEL" key has been operated during the advance notice ("YES" in Step S29), the system CPU 10 continues the copying operation (Step S36) instead of immediately executing the image quality maintenance adjustment. The suspended image quality maintenance adjustment is executed (Step S38) at the end of the copying operation (Step S37).

In this manner, if the key for canceling the image quality maintenance adjustment is operated during the advance notice of the adjustment, the system CPU 10 first completes the ongoing job and then executes the image quality maintenance adjustment.

At the end of the image quality maintenance adjustment, which is executed after the completion of the copying operation, the system CPU 10 resets the value (TIMER_A2) of timer 10*c* and causes it to newly start time measurement (Step S39). Subsequently, the control returns to step S21.

In the example described above, reference was made to the operation performed when the digital copying machine is executing a copying operation (job). Even if the digital copying machine is in the standby state and is not executing any job, the advance notice of the image quality maintenance adjustment is given when the predetermined advance notice time comes. If, in this case, the cancel key of the display shown in FIG. 7 is designated, the copying operation to be performed next (i.e., the job to be done next) is executed first, and then the image quality maintenance adjustment is made. Owing to this feature, the image quality maintenance adjustment is not performed against the user's intention.

In the above, reference was made as to how the automatic image quality maintenance adjustment was made. When the automatic alignment adjustment is made, steps that are similar to those shown in FIG. 8 are applicable.

As described above, if the advance notice start time, which is predetermined on the basis of the elapse of time from the last image quality maintenance operation or the last automatic alignment operation, comes during the execution of the copying operation, the advance notice of either the automatic image quality maintenance adjustment or the automatic alignment adjustment is given. If the cancellation of either the image quality maintenance adjustment or the automatic alignment adjustment is designated in the meantime, the copying operation is completed first, and then either the image quality maintenance adjustment or the automatic alignment adjustment is made. Owing to this feature, the image quality or position does not significantly change during the copying operation. Moreover, it is not necessary to wait for the image quality maintenance adjustment or the position alignment adjustment to come to an end.

If the advance notice start time comes when no copying operation is executed, the advance notice of the image quality maintenance adjustment is given. If the cancellation of either the image quality maintenance adjustment or the automatic alignment adjustment is designated in the meantime, the canceled image quality maintenance adjustment or automatic alignment adjustment is made after the subsequent copying operation is completed. Owing to this feature, the copying operation is not interrupted by the image quality maintenance adjustment or the position alignment adjustment.

A description will now be given as to how the automatic image quality maintenance adjustment is made on the basis of the total number of copy sheets on which images have been formed up to the present.

Figure 9:
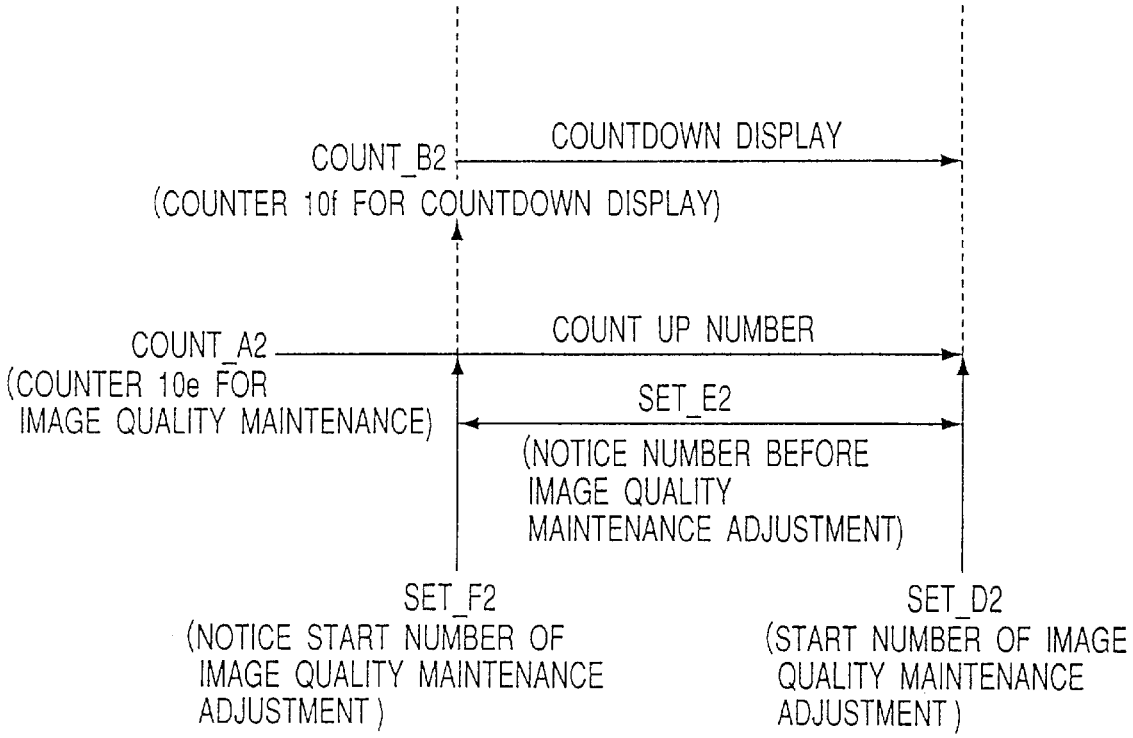
FIG. 9 is a count table illustrating counts (the number of sheets) regarding the automatic image quality maintenance (alignment) adjustment.

FIG. 9 is a counter table used in the case where the automatic image quality maintenance adjustment is made. As shown in FIG. 9, the automatic image quality maintenance adjustment can be controlled on the basis of the number of copy sheets on which images have been printed up to the present. In this case, the adjustment is controlled on the basis of the following: the start number (SET_D2) for starting the automatic image quality maintenance adjustment; the notice number (SET_E2) which is displayed and counted down as the advance notice of the automatic image quality maintenance adjustment and which is equal to the number of copy sheets left before the execution of the automatic image quality maintenance adjustment; and a notice start number (SET_F2) for starting the advance notice of the automatic image quality maintenance adjustment.

The start number (SET_D2) and the notice number (SET_E2) are values predetermined in the self-diagnosis setting mode. The start number represents the total number of copy sheets corresponding to the period of time between the execution of the last image quality maintenance adjustment and the start of the next image quality maintenance adjustment. The notice number (SET_E2) is the copy number for starting the advance notice. When the advance notice of the automatic image quality maintenance adjustment is started, the copy number corresponding to the notice number (SET_E2) is displayed and counted down. The notice start number (SET_F2) represents the total number of copies based on which the advance notice of the automatic image quality maintenance adjustment is started. The notice start number (SET_F2) is computed by the system CPU 10 on the basis of the start time (SET_D2) and the start number (SET_E2) and is stored in the NVM 13.

The system CPU 10 is provided with counter 10*e* for counting up a copy number (COUNT_A2) and counter 10*f* for counting down a copy number (COUNT_B2). Counter 10*e* starts counting up the copy number (COUNT_A2) from the time when the last image quality maintenance adjustment is ended. In other words, when the image quality maintenance adjustment is made, the system CPU 10 resets the value of counter 10*e* (COUNT_A2=0) and causes counter 10*e* to start counting up the copy number.

On the other hand, counter 10*f* counts down the number of printed copies (COUNT_B2) until it equals to the start number of the image quality maintenance adjustment. When the counted number becomes equal the start number of the advance notice, the notice number of the advance notice of the image quality maintenance adjustment is set for counter 10*f*. The set notice number is counted down each time one copy sheet is printed. When the copy number (COUNT_B2) counted down by counter 10*f* becomes "0", the automatic image quality maintenance adjustment is started.

In the example described above, the control is executed by use of two counters, namely, counters 10*e* and 10*f*. Instead of this, only one of the counter for counting up and the counter for counting down may be used for controlling the operation. For example, in the case where the operation is controlled by employing the counter for counting down, the countdown operation is started when the last automatic image quality maintenance adjustment has ended, and is continued until the start time of the next automatic image quality maintenance adjustment. When the counted-down number becomes equal to the notice number, the advance notice of the image quality maintenance adjustment is performed.

In the above description, reference was made to the counter table of the automatic image quality maintenance adjustment. In the case of the automatic alignment adjustment, a counter table similar to that shown in FIG. 9 is applicable, and an operation can be performed based on such a counter table.

Figure 10:
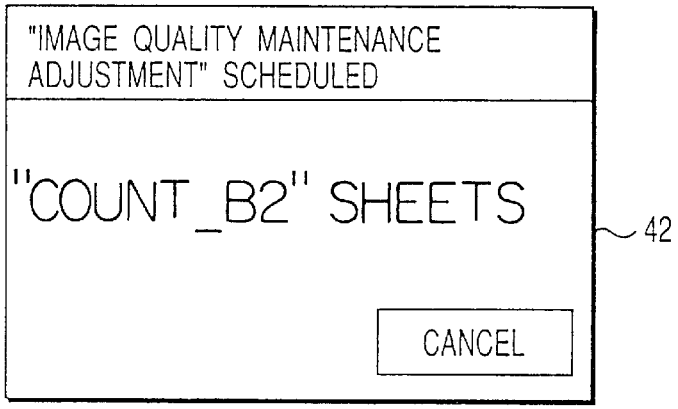
FIG. 10 shows example of a message which the liquid crystal display device displays to notify the user of entry into the automatic image quality maintenance adjustment (alignment) mode in advance.

FIG. 10 shows an example of a message which the LCD 42 displays to notify the user of the image quality maintenance adjustment in advance on the basis of number of copies. As shown in FIG. 10, the advance notice of the image quality maintenance adjustment is given by causing the LCD 42 to display the message "'IMAGE QUALITY MAINTAINING ADJUSTMENT' SCHEDULED", as well as the number of sheets ("'COUNT-B2' SHEETS") left before the image quality maintenance adjustment. The LCD also displays "CANCEL" key which provided as a key on the touch panel 42*a* and which enables entry of a designation.

Let us assume that the user comes to the digital copying machine 1 and operates the "CANCEL" key when the display message shown in FIG. 10 is indicated. By this operation, the image quality maintenance adjustment is not executed during the copying operation subsequently executed by the user. Owing to this feature, the image quality maintenance adjustment operation for which the user operates the "CANCEL" key is executed at the end of the user's subsequent copying operation, if the start number of the image quality maintenance adjustment is counted during that copying operation. If the start number of the image quality maintenance adjustment is not counted during the user's subsequent copying operation, the advance notice is continued.

As can be seen from this, if the image quality maintenance adjustment is about to start during the copying operation, it can be controlled by the user's designation in such a manner that it starts after the end of the copying operation. In this manner, the image quality maintenance operation is not started during the copying operation. Hence, the copying operation can be performed smoothly, and the image quality does not significantly change before and after the image quality maintenance adjustment.

When the user is making a copy, it may happen that the count of the counter 10*e* for the automatic image quality maintenance adjustment will reach the notice number. If this does happen, the LCD 42 displays such a display screen as shown in FIG. 10. If the user does not do anything in such a situation, the image quality maintenance adjustment is started when the remaining number displayed on the LCD 42 becomes "0." Once the image quality maintenance adjustment is started, the copying function of the digital copying machine 1 is not available until the image quality maintenance adjustment comes to an end. Furthermore, if the image quality maintenance adjustment is made during a copying operation executed for a plurality of pages, the quality of the images printed on copy sheets may differ before and after the image quality maintenance operation. To avoid these inconveniences, the image quality maintenance adjustment is made after the completion of the copying operation in response to the user's designation.

Let us assume that the display screen (such as that shown in FIG. 10) representing the advance notice of the image quality maintenance adjustment operation is shown during a copying operation executed for a plurality of pages. If, in this case, the user operates the "CANCEL" key, the image quality maintenance adjustment during the copying operation is avoided. In other words, the image quality maintenance adjustment is executed after the completion of the ongoing copying operation. Hence, the image quality maintenance adjustment during the copying operation, which is contrary to the user's intention, is not executed, and the image quality of print results does not vary before and after the image quality maintenance adjustment.

In the case described above, reference was made to the case where the advance notice of the automatic image quality maintenance adjustment was displayed. In the case where the present invention is applied to the advance notice of the automatic alignment adjustment, a display screen similar to that shown in FIG. 10 can be indicated as an advance notice. In the case of the advance notice of the automatic alignment adjustment, however, the guide message "'IMAGE QUALITY MAINTAINING ADJUSTMENT' SCHEDULED" is replaced with the "'AUTOMATIC ALIGNMENT ADJUSTMENT' SCHEDULED", and the display of the counted-down remaining time is replaced with the display of the counted-down number of remaining copies.

Figure 11:
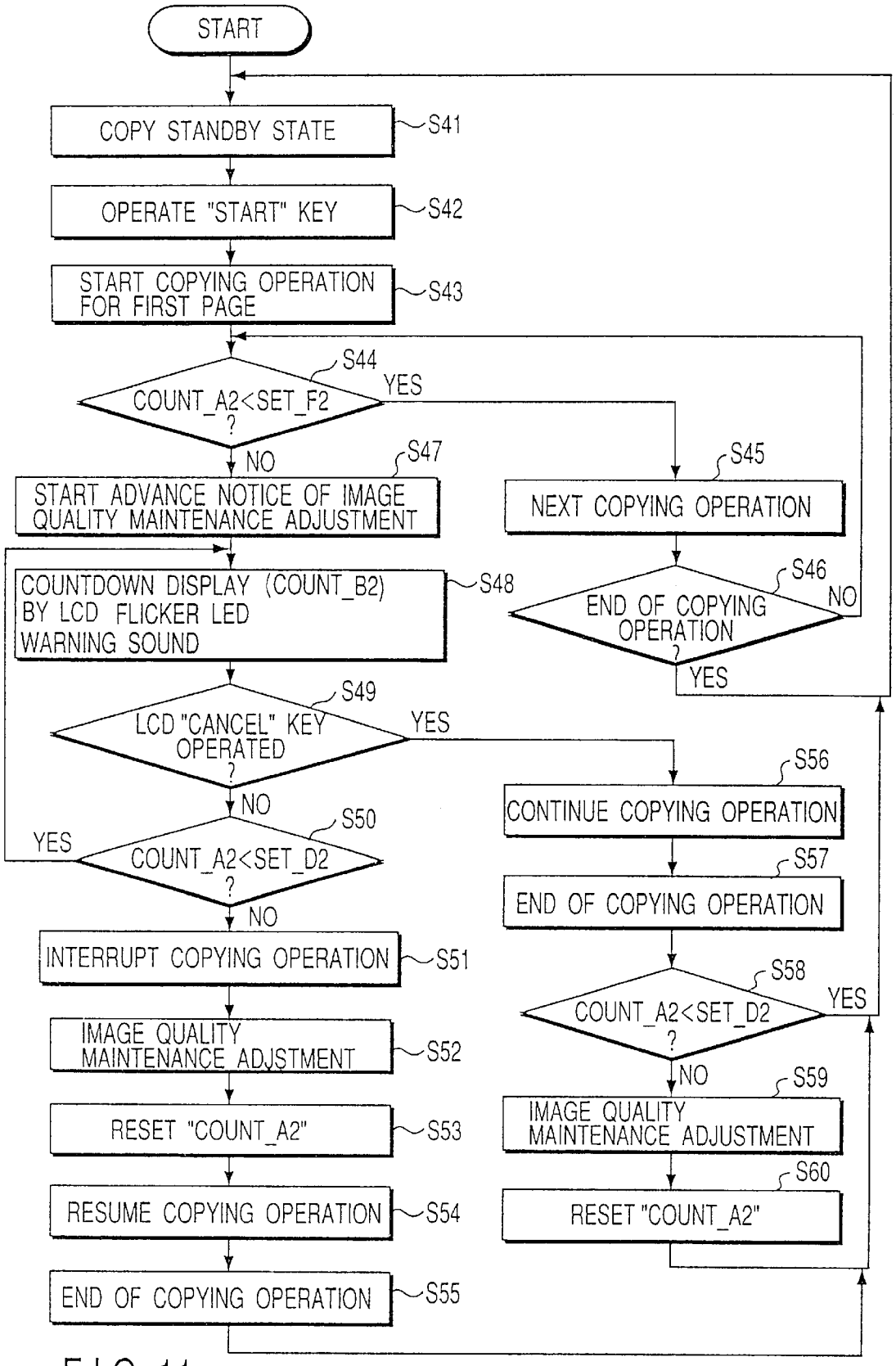
FIG. 11 is a flowchart illustrating the operation of the automatic image quality maintenance (alignment) adjustment.

FIG. 11 is a flowchart illustrating how the automatic image quality maintenance adjustment is made on the basis of the total number of copies.

Let us assume that the digital copying machine 1 is in the copy standby state (Step S41) and that the user places a plural-page document on the ADF 35 and operates the "START" key (Step S42). In response, the system CPU 10 starts a copying operation for the first page of the document (Step S43). The system CPU 10 manages, as one job, the copying processing for the document the user places on the ADF 35.

Each time a copying operation is made, the value (COUNT_A2) of counter 10*e* is counted up. The system CPU 10 compares the value (COUNT_A2) of counter 10*e* with the notice start number (SET_F2) of the automatic image quality maintenance adjustment, so as to determine whether or not "SET_F2" is greater than "COUNT_A2" (Step S44).

If this determination shows that the notice start number (SET_F2) of the automatic image quality maintenance adjustment is greater than the value (COUNT_A2) of counter 10*e* ("YES" in Step S44), then the system CPU 10 continues the copying operation for the next image (Step S45). When the copying operation comes to an end ("YES" in Step S46), the system CPU 10 returns to step S41 and the digital copying machine 1 is set in the copy standby state. If the copying operation has not yet been completed ("NO" in step S46), the system CPU 10 returns to Step S44 to compare "COUNT_A2" with "SET F2."

Conversely, if the determination does not show that the notice start number (SET_F2) of the automatic image quality maintenance adjustment is greater than the value (COUNT_A2) of counter 10*e* ("NO" in Step S44), the system CPU 10 starts the advance notice of the automatic image quality maintenance adjustment (Step S47). The advance notice of this automatic image quality maintenance adjustment is carried out on the basis of the contents determined in the automatic diagnosis-setting mode. That is, the system CPU 10 causes the LCD 42 to indicate and count down the number of copies remaining before the start of the image quality maintenance adjustment. In addition, on the basis of the settings, the system CPU 10 controls the LED display unit 18 to flicker the LED 18*a* or controls the speaker 17 to generate a warning sound (Step S48).

During the execution of this advance notice, the system CPU 10 checks whether or not the "CANCEL" key of the display screen of the LCD 42 shown in FIG. 10 has been operated (Step S49). If this determination shows that the "CANCEL" key has not been operated ("NO" in Step S49), the system CPU 10 compares the value (COUNT_A2) of counter 10*e* with the start number (SET_D2) of the automatic image-maintenance adjustment (the data on the start time being stored in the NVM 13). On the basis of the results of this comparison, the system CPU 10 determines whether "SET_D2" is greater than "COUNT A2" (Step S50).

If it is determined that the start number (SET_D2) of the automatic image quality maintenance adjustment is greater than the value (COUNT_A2) of counter 10*e* ("YES" in Step S50), then the system CPU 10 returns to Step S48, and continues the advance notice. If the determination does not show that the start number (SET_D2) of the automatic image quality maintenance adjustment is greater than the value (COUNT_A2) of counter 10*e* ("NO" IN Step S50), the system CPU 10 interrupts the copying operation that is then being executed (Step S51), and starts the image quality maintenance adjustment (Step S52).

When this image quality maintenance adjustment comes to an end, the system CPU 10 resets the value (COUNT_A2) of counter 10*e* and causes it to newly start time measurement (Step S53). In addition, the system CPU 10 resumes the interrupted copying operation (Step S54) at the end of the image quality maintenance adjustment. When the copying operation is completed (Step S55), the system CPU 10 returns to step S41 to set the digital copying machine 1 into the copy standby state.

If the determination in Step S49 indicates that the "CANCEL" key has been operated during the advance notice ("YES" in Step S49), the system CPU 10 continues the copying operation (Step S56) instead of immediately executing the image quality maintenance adjustment. At the end of this copying operation (Step S57), the system CPU 10 determines once again whether the start number (SET_D2) of the image quality maintenance adjustment is greater than the value (COUNT_A2) of counter 10*e* (Step S58). If the determination shows that the start number (SET_D2) of the image quality maintenance adjustment is greater than the value (COUNT_A2) of counter 10*e* ("YES" in Step S58), the system CPU 10 returns to Step S41 and sets the digital copying machine 1 into the copy standby mode.

If the determination dos not show that the start number (SET_D2) of the image quality maintenance adjustment is greater than the value (COUNT_A2) of counter 10*e* ("NO" in Step S58), the system CPU 10 starts the image quality maintenance adjustment (Step S59). At the end of this image quality maintenance adjustment, the system CPU 10 resets the value (COUNT_A2) of counter 10*e* used for the image quality maintenance operation (Step S60) and causes counter 10*e* to newly measure the elapse of time. After this processing, the system CPU 10 returns to step S41 and sets the digital copying machine 1 into the copy standby mode.

In the example described above, reference was made to the operation performed when the digital copying machine is executing a copying operation (job). Even if the digital copying machine is in the standby state and is not executing any job, the advance notice of the image quality maintenance adjustment is given when the predetermined advance notice time comes. If, in this case, the cancel key of the display shown in FIG. 10 is designated, the copying operation to be performed next (i.e., the job to be done next) is executed first, and then the image quality maintenance adjustment is made.

In the above, reference was made as to how the automatic image quality maintenance adjustment was made. When the automatic alignment adjustment is made, steps that are similar to those shown in FIG. 10 are applicable.

As described above, if the advance notice start number, which is predetermined on the basis of the number of copies made from the last image quality maintenance operation or the last automatic alignment operation, is counted during the execution of the copying operation, the advance notice of either the automatic image quality maintenance adjustment or the automatic alignment adjustment is given. If the cancellation of either the image quality maintenance adjustment or the automatic alignment adjustment is designated in the meantime, the copying operation is completed first, and then either the image quality maintenance adjustment or the automatic alignment adjustment is made. Owing to this feature, the image quality or position does not significantly change during the copying operation.

If the advance notice start number is counted when no copying operation is executed, the advance notice of the image quality maintenance adjustment is given. If the cancellation of either the image quality maintenance adjustment or the automatic alignment adjustment is designated in the meantime, the canceled image quality maintenance adjustment or automatic alignment adjustment is made after the subsequent copying operation is completed. Owing to this feature, the copying operation is not interrupted by the image quality maintenance adjustment or the position alignment adjustment.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. An image forming apparatus provided with an operation section with which a user enters designations, and an image formation section for forming an image on an image formation medium, said image forming apparatus comprising:

a memory to store a first period of time and a second period of time, said first period of time being defined between a point of time when a standby state, where the image formation section is ready to form an image is switched on and a point of time when an event is started, said second period of time being defined between the point of time when the standby state is switched on and the start of an advance notice of the execution of the event;

a timer to measure a length of time starting from the point of time when the standby state is switched on;

a display device to display a period of time left before the start of the event, when the length of time measured by the timer indicates the elapse of the second period of time and to keep operating until the event is started; and a control section to reset the period of time measured by the timer, with the standby state maintained, when a designation is entered from the operation section in the state where the display device is displaying the period of time left before the start of the event, and to start the event when the first period of time has elapsed without no designation being entered from the operation section.

2. An image forming apparatus according to claim 1, further comprising:

a countdown timer for counting down the time left before the start of the event, the countdown timer being designed to start operating when the length of time measured by the timer indicates the elapse of the second period of time and keep operating until the event is started, said display device displaying the time measured by the countdown timer.

3. An image forming apparatus according to claim 1, further comprising:

at least one of an LED display device and a speaker, said LED display device indicating an LED and said speaker generating a warning sound, said LED display device and said speaker being designed to start operating when the length of time measured by the timer indicates the elapse of the second period of time and keep operating until the event is started.

4. An image forming apparatus according to claim 1, further comprising:

setting means for allowing the first period of time and a third period of time, which is a length of time for which said display device keeps operating, to be entered from the operation section; and computing means for computing the second period of time based on the first and third periods of time set by the setting means, said memory storing the first and third periods of time set by the setting means and the second period of time computed by the computing means.

5. An image forming apparatus according to claim 1, wherein:

said event is an auto power off operation for turning off a main power supply to the image forming apparatus;

when a designation is entered from the operation section in a state where the display device displays a length of time left before the auto power off operation, said control section resets the length of time measured by the timer while maintaining the standby state; and when the length of time measured by the timer exceeds the first period of time, without any designation being entered from the operation section, said control section turns off the main power supply.

6. An image forming apparatus according to claim 1, wherein:

said event is an auto power save operation for switching the image forming apparatus into a power save mode, said power save mode being a mode which reduces power consumption and allows the image forming apparatus to be in the standby state and which requires the startup operation before starting image formation;

when a designation is entered from the operation section in a state where the display device displays a length of time left before the auto power save operation, said control section resets the length of time measured by the timer while maintaining the standby state; and when the length of time measured by the timer exceeds the first period of time, without any designation being entered from the operation section, said control section switches the image forming apparatus into the power save mode.

7. An image forming apparatus provided with an operation section with which a user enters designations, and an image formation section for forming an image on an image formation medium, said image forming apparatus comprising:

a memory to store a first period of time and a second period of time, the first period of time being defined between the end of a last event and the start of a next event, the second period of time being defined between the end of the last event and the start of a notice of the next event;

a timer to measure a length of time starting from the end of the last event;

a display device to display a period of time left before the start of the event, the display device being designed to start operating when the length of time measured by the timer indicates the elapse of the second period of time and to keep operating until the event is started; and a control section to control a subsequently-scheduled event to be executed after the end of image formation which is then being executed by the image formation section, when a cancel command for canceling the subsequently-scheduled event is entered from the operation section in the state where the display device is displaying the period of time left before the start of the event.

8. An image forming apparatus according to claim 7, further comprising:

a countdown timer for counting down the time left before the start of the event, the countdown timer being designed to start operating when the length of time measured by the timer indicates the elapse of the second period of time and keep operating until the event is started, said display device displaying the time measured by the countdown timer.

9. An image forming apparatus according to claim 7, further comprising:

at least one of an LED display device and a speaker, said LED display device indicating an LED and said speaker generating a warning sound, said LED display device and said speaker being designed to start operating when the length of time measured by the timer indicates the elapse of the second period of time and keep operating until the event is started.

10. An image forming apparatus according to claim 7, further comprising:

setting means for allowing the first period of time and a third period of time, which is a length of time for which said display device keeps operating, to be entered from the operation section; and computing means for computing the second period of time based on the first and third periods of time set by the setting means, said memory storing the first and third periods of time set by the setting means and the second period of time computed by the computing means.

11. An image forming apparatus according to claim 7, wherein:

said image formation section performs image formation based on jobs, which are processing units of image formation; and when one job is being executed and if cancellation of an event is designated in a state where said display device displays a length of time left before start of said event, then said one job is first completed, and then said event is executed.

12. An image forming apparatus according to claim 7, wherein:

said image formation section performs image formation based on jobs, which are processing units of image formation; and when no job is being executed and if cancellation of an event is designated in a state where said display device displays a length of time left before start of said event, then a subsequent job is first completed, and then said event is executed.

13. An image forming apparatus according to claim 7, wherein said event is one of an automatic image quality maintenance adjustment for making adjustments to maintain a desirable image quality, and an automatic position alignment adjustment for making adjustments to maintain a desirable image position.

14. An image forming apparatus provided with an operation section with which a user enters designations, and an image formation section for forming an image on an image formation medium, said image forming apparatus comprising:

a memory to store a first value and a second value, the first value representing the number of image formation mediums on which the image formation section forms an image between the point of time when a last event is executed and the point of time when a next event is started, the second value representing the number of image formation mediums on which the image formation section forms an image between the point of time when the last event is executed and the point of time when a notice of the next event is issued;

a counter to count the number of image formation mediums on which the image formation section forms an image after the end of the last event;

a display device to display the number of image formation mediums left unprocessed before the start of the next event, when the number of image formation mediums counted by the counter has reached the second value and to keep operating until the next event is started; and a control section to control a subsequently-scheduled event to be executed after the end of image formation which is then being executed by the image formation section, when a cancel command for canceling the subsequently-scheduled event is entered from the operation section in the state where the display device is displaying the number of image formation mediums left unprocessed before the start of the next event.

15. An image forming apparatus according to claim 14, further comprising:

a countdown counter to count down the number of image formation mediums left unprocessed before the start of the next event, the countdown counter being designed to start operating when the number counted by the counter has reached the second value and keep operating until the next event is started, said display device displaying the number counted by the countdown counter.

16. An image forming apparatus according to claim 14, further comprising:

at least one of an LED display device and a speaker, said LED display device indicating an LED and said speaker generating a warning sound, said LED display device and said speaker being designed to start operating when the number counted by the counter has reached the second value and keep operating until the next event is started.

17. An image forming apparatus according to claim 14, further comprising:

setting means for allowing the first value and a third value, which is a number of image formation medium for which said display device keeps operating, to be entered from the operation section; and computing means for computing the second value based on the first and third values set by the setting means, said memory storing the first and third values set by the setting means and the second value computed by the computing means.

18. An image forming apparatus according to claim 14, wherein:

said image formation section performs image formation based on jobs, which are processing units of image formation; and when one job is being executed and if cancellation of the next event is designated in a state where said display device displays a number of image formation mediums left unprocessed before start of said next event, then said one job is first completed, and then said next event is executed.

19. An image forming apparatus according to claim 14, wherein:

said image formation section performs image formation based on jobs, which are processing units of image formation; and when no job is being executed and if cancellation of the next event is designated in a state where said display device displays a number of image formation mediums left unprocessed before start of said next event, then a subsequent job is first completed, and then said next event is executed.

20. An image forming method of an image forming apparatus provided with an operation section with which a user enters designations, and an image formation section for forming an image on an image formation medium, comprising:

storing a first period of time and a second period of time in a memory, said first period of time being defined between a point of time when a standby state, where the image formation section is ready to form an image, is switched on and a point of time when an event is started, said second period of time being defined between the point of time when the standby state is switched on and the start of advance notice of the execution of the event;

measuring length of time starting from the point of time by a timer when the standby state is switched on;

displaying the period of time left before the start of the event on a display device, when the length of time measured by the timer indicates the elapse of the second period of time and to keep operating until the event is started; and resetting the period of time measured by the timer, with the standby state maintained, when a designation is entered from the operation section in the state where the display device is displaying the time left before the start of the event, and starting the event when the first period of time has elapsed without no designation being entered from the operation section.

21. An image forming apparatus provided with an operation section with which a user enters designations, and an image formation section for forming an image on an image formation medium, said image forming apparatus comprising:

means for storing a first period of time and a second period of time, said first period of time being defined between a point of time when a standby state, where the image formation section is ready to form an image is switched on and a point of time when an event is started, said second period of time being defined between the point of time when the standby state is switched on and the start of advance notice of the execution of the event;

means for measuring length of time starting from the point of time when the standby state is switched on;

means for displaying the period of time left before the start of the event, when the length of time measured by said measuring means indicates the elapse of the second period of time and to keep operating until the event is started; and means for resetting the period of time measured by said measuring means with the standby state maintained, when a designation is entered from the operation section in the state where said displaying means is displaying the time left before the start of the event, and for starting the event when the first period of time has elapsed without no designation being entered from the operation section.

* * * * *